US010543526B2

(12) United States Patent
Era et al.

(10) Patent No.: US 10,543,526 B2
(45) Date of Patent: Jan. 28, 2020

(54) METHOD FOR REMOVING BURRS OF SAND CORE FOR CASTING

(71) Applicant: TOYOTA JIDOSHA KABUSHIKI KAISHA, Toyota-shi (JP)

(72) Inventors: Naoya Era, Toyota (JP); Katsuhiro Takami, Ichinomiya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/199,287

(22) Filed: Nov. 26, 2018

(65) Prior Publication Data

US 2019/0193143 A1 Jun. 27, 2019

(30) Foreign Application Priority Data

Dec. 22, 2017 (JP) ..... 2017-246294

(51) Int. Cl.

| | |
|---|---|
| ***B22C 9/18*** | (2006.01) |
| ***B22C 9/10*** | (2006.01) |
| *B22C 13/12* | (2006.01) |

(52) U.S. Cl.
CPC ..... *B22C 9/18* (2013.01); *B22C 9/10* (2013.01); *B22C 13/12* (2013.01)

(58) Field of Classification Search
CPC ..... B22C 9/18; B22C 9/10; B22C 13/12
See application file for complete search history.

(56) References Cited

FOREIGN PATENT DOCUMENTS

| | | |
|---|---|---|
| JP | 61-107465 U | 7/1986 |
| JP | 7-136739 | 5/1995 |

*Primary Examiner* — Kevin P Kerns
*Assistant Examiner* — Steven S Ha
(74) *Attorney, Agent, or Firm* — Oblon, McClelland, Maier & Neustadt, L.L.P.

(57) ABSTRACT

A deburring method for a casting sand core 40 for removing burrs from a deburring target part 41 in the casting sand core 40 including the deburring target part 41, the deburring target part 41 being at least one of an opening and a cut-out part. The deburring method includes: inserting a bag 13 into the deburring target part 41 of the casting sand core 40; and inflating the bag 13 inserted into the deburring target part 41, and thereby pressing and breaking off burrs 42 formed on a peripheral surface of the deburring target part 41 by the inflated bag 13.

5 Claims, 7 Drawing Sheets

METHOD FOR REMOVING BURRS OF SAND CORE FOR CASTING

CROSS REFERENCE TO RELATED APPLICATIONS

This application is based upon and claims the benefit of priority from Japanese patent application No. 2017-246294, filed on Dec. 22, 2017, the disclosure of which is incorporated herein in its entirety by reference.

BACKGROUND

The present disclosure relates to a method for removing burrs of a sand core for casting.

A sand core for casting (hereinafter also referred to as a "casting sand core") is molded inside a plurality of divided dies. Therefore, burrs are formed on the casting sand core along a surface on which the dies are joined to each other, i.e., along a parting surface of the dies. Needless to say, it is necessary to remove the burrs from the casting sand core. Japanese Unexamined Patent Application Publication No. H7-136739 discloses a method in which burrs are removed while rotating a bundle of metal wires attached to a tip of a rotation shaft.

SUMMARY

The present inventors have found the following problem related to the method for removing burrs of a casting sand core.

In the burr removing method disclosed in Japanese Unexamined Patent Application Publication No. H7-136739, burrs are scraped off by rotating a bundle of metal wires and thereby spreading their tips. Note that the bundle of metal wires could be deformed due to an aged deterioration, a sudden excessive load, etc. When the bundle of metal wires is deformed, the bundle of metal wires cannot be brought into contact with burrs as intended. Therefore, there is a possibility that burrs cannot be sufficiently removed or a main body of a casting sand core is damaged (e.g., scratched).

The present disclosure has been made in view of the above-described circumstances and an object thereof is to provide a method for removing burrs of a casting sand core, capable of sufficiently removing burrs while preventing a main body of a casting sand core from being damaged.

A first exemplary aspect is a deburring method for a casting sand core for removing a burr from a deburring target part in the casting sand core including the deburring target part, the deburring target part being at least one of an opening and a cut-out part, the deburring method including:

inserting a bag into the deburring target part of the casting sand core; and inflating the bag inserted into the deburring target part, and thereby pressing and breaking off a burr formed on a peripheral surface of the deburring target part by the inflated bag.

In the deburring method for a casting sand core according to the above-described aspect of the present disclosure, the bag inserted into the deburring target part is inflated and burrs formed on a peripheral surface of the deburring target part are pressed and broken off by the inflated bag. Therefore, it is possible to prevent burrs from being locally and excessively removed and prevent areas having no burr formed therein from being unnecessarily scraped on the peripheral surface of the deburring target part. That is, it is possible to sufficiently remove burrs while preventing a main body of a casting sand core from being damaged.

When a pair of deburring target parts is arranged so as to be opposed to each other with a partition part interposed therebetween, after the bag and another bag are separately inserted into the pair of deburring target parts respectively, the bag and the other bag, which have been separately inserted into the pair of deburring target parts respectively, are simultaneously inflated. Since the partition part is sandwiched between two inflated bags, the partition part can be prevented from being broken.

The deburring target part may be a cut-out part. The bag inserted into the deburring target part may be inflated after a plate-like member is placed to abut against an outer periphery of the casting sand core and thereby to cover the cut-out part. It is possible to reduce an amount of a medium that is supplied to inflate the bag, and thereby to efficiently remove burrs.

The bag may be inflated by supplying air to the bag. The bag can be easily inflated at low cost.

Further, the bag may be attached to a tip of a nozzle. The bag can be easily inserted into the deburring target part even when the deburring target part is small.

According to the present disclosure, it is possible to sufficiently remove burrs while preventing a main body of a casting sand core from being damaged.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Specific embodiments to which the present disclosure is applied will be described hereinafter in detail with reference to the drawings. However, the present disclosure is not limited to the below-shown embodiments. Further, the following descriptions and drawings are simplified as appropriate for clarifying the explanation.

First Embodiment

<Configuration of Burr Removing Apparatus>

Firstly, a burr removing apparatus used in a method for removing burrs of a casting sand core according to a first embodiment is described with reference to FIG. 1.

Figure 1:
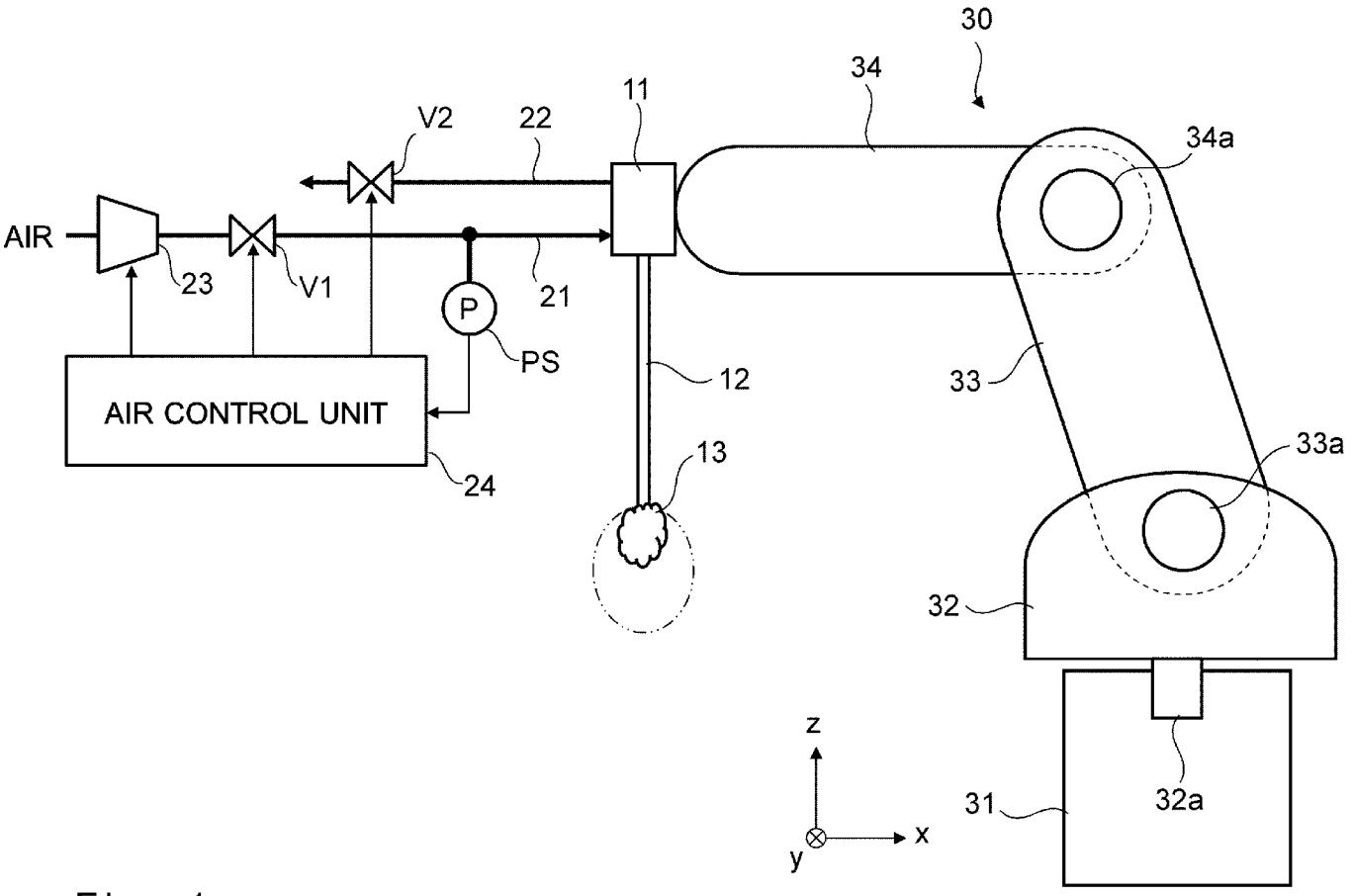
FIG. 1 is a configuration diagram of a burr removing apparatus used in a method for removing burrs of a casting sand core according to a first embodiment.

FIG. 1 is a configuration diagram of a burr removing apparatus used for a method for removing burrs of a casting sand core according to the first embodiment. As shown in FIG. 1, the burr removing apparatus includes an attachment unit 11, a nozzle 12, a bag 13, an air supply pipe 21, an air discharge pipe 22, a compressor 23, an air control unit 24, solenoid valves V1 and V2, a pressure sensor PS, and a robot arm 30.

Note that, needless to say, right-handed xyz-coordinate systems shown in FIG. 1 and other figures are shown just for illustrating positional relations among components. Generally, a z-axis positive direction is a vertically upward direction and an xy-plane is a horizontal plane, and they are applicable to all of the drawings.

The attachment unit 11 is a connection member attached to a tip of the robot arm 30. As shown in FIG. 1, the nozzle 12, the air supply pipe 21, and the air discharge pipe 22 are connected through the attachment unit 11.

The nozzle 12 is a tubular member that extends vertically downward (in a z-axis negative direction) from the attachment unit 11.

The bag 13 is attached to the tip of the nozzle 12. The bag 13 expands (i.e., is inflated) when air is supplied to the bag 13 through the nozzle 12 and contracts (i.e., is deflated) when air is discharged from the bag 13 through the nozzle 12. A state in which the bag 13 is inflated is indicated by a chain double-dashed line. Further, since the bag 13 is connected to the robot arm 30 through the nozzle 12 and the attachment unit 11, the position of the bag 13 can be freely moved.

The material for the bag 13 is not limited to any particular materials. For example, the bag 13 is made of resin. Examples of the resin constituting the bag 13 include PP (polypropylene), PET (polyethylene terephthalate), PEN (polyethylene naphthalate), nitrile rubber, and polytrimethylene terephthalate fiber.

In the example shown in FIG. 1, since the resin constituting the bag 13 has elasticity, the inflated bag 13 can be deflated without using a discharging device. Needless to say, the resin constituting the bag 13 does not have to be elastic. Further, in order to improve durability of the bag 13, the resin constituting the bag 13 may have resistance to cutting.

As shown in FIG. 1, the air supply pipe 21 extends from the attachment unit 11 to the compressor 23. The solenoid valve V1 is disposed in the air supply pipe 21 which extends between the compressor 23 and the attachment unit 11. Further, the pressure sensor PS is disposed in a section of the air supply pipe 21 located between the solenoid valve V1 and the attachment unit 11. It is possible to measure an air pressure inside the bag 13 by the pressure sensor PS.

Meanwhile, the solenoid valve V2 is disposed in the air discharge pipe 22 connected to the attachment unit 11.

The air control unit 24 controls On/Off of the compressor 23 and opening/closing of the solenoid valves V1 and V2. The air control unit 24 controls the opening/closing of the solenoid valve V1 based on a signal from the pressure sensor PS, i.e., based on the pressure inside the bag 13. More detailed explanations are given below.

Firstly, when the air control unit 24 turns on the compressor 23 and opens the solenoid valve V1, air is supplied to the bag 13 and hence the bag 13 is inflated. In this process, the solenoid valve V2 is closed. As will be described later in detail, the inflated bag 13 presses and breaks off burrs of a casting sand core and hence the burrs are removed from the casting sand core.

Next, when the pressure inside the bag 13 rises to a predetermined reference value, the air control section 24 closes the solenoid valve V1 and thereby stops the supply of air to the bag 13.

Then, the air control unit 24 opens the solenoid valve V2. As a result, air is discharged from the bag 13 and hence the bag 13 is deflated.

Note that the medium for inflating the bag 13 is not limited to air. That is, other gases may be used as the medium. Further, the medium may be a liquid. However, by using air, the bag 13 can be easily inflated at low cost.

Next, the robot arm 30 is described.

The robot arm 30 is moving means for three-dimensionally moving the bag 13. The robot arm 30 is a multi joint robot arm including a base part 31, a link base part 32, a first link 33, and a second link 34.

The link base part 32 is connected to the base part 31 so that the link base part 32 can rotate about a yaw axis. The yaw axis is a rotation axis 32*a* of the link base part 32 and is an axis in the vertical direction (the z-axis direction).

The first link 33 is connected to the link base part 32 through a first joint part 33*a* so that the first link 33 can rotate about a pitch axis.

The second link 34 is connected to the first link 33 through a second joint part 34*a* so that the second link 34 can rotate about the pitch axis. Further, the attachment unit 11 is connected to the other end of the second link 34.

The pitch axis is a rotation axis about which the first and second links 33 and 34 rotate in the vertical direction and is an axis in the y-axis direction in the state shown in FIG. 1.

The base part 31 is provided with a motor for rotationally driving the link base part 32 about the yaw axis, though it is not shown in the figure. Further, the first joint part 33*a* is provided with a motor for rotationally driving the first link 33 about the pitch axis. The second joint part 34*a* is provided with a motor for rotationally driving the second link 34 about the pitch axis.

Further, the moving means for three-dimensionally moving the bag 13 is not limited to any particular means. For example, an orthogonal moving mechanism or the like may be used instead of using the robot arm 30.

<Configuration of Casting Sand Core>

Figure 2:
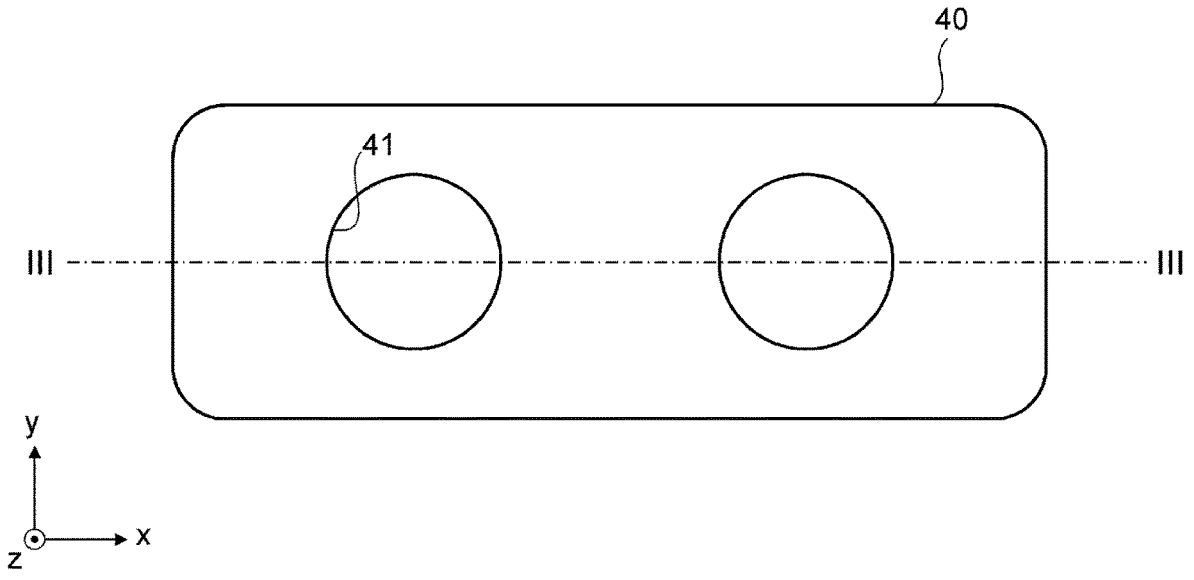
FIG. 2 is a schematic plan view of a casting sand core from which burrs are removed by using a method for removing burrs of a casting sand core according to the first embodiment.
Figure 3:
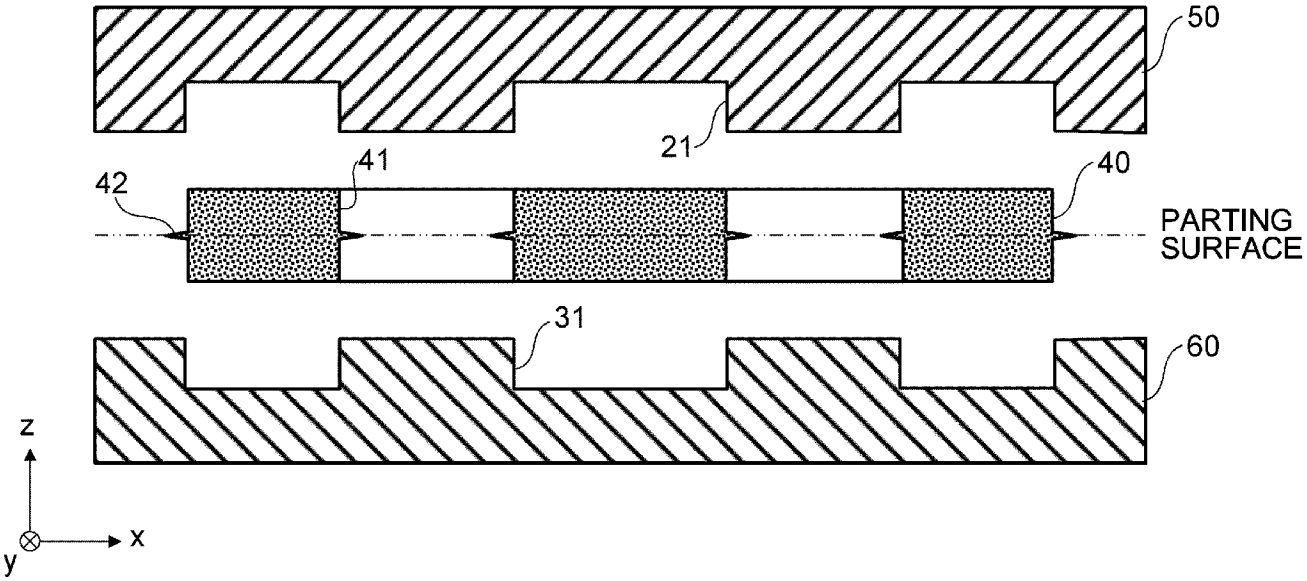
FIG. 3 is a cross section taken along a line in FIG. 2.

Next, a casting sand core from which burrs are removed by using a method for removing burrs of a casting sand core according to the first embodiment is described with reference to FIGS. 2 and 3. FIG. 2 is a schematic plan view of an example of a casting sand core from which burrs are removed by using a method for removing burrs of a casting sand core according to the first embodiment. FIG. 3 is a cross section taken along a line in FIG. 2. FIG. 3 also shows an upper die 50 and a lower die 60 in addition to the casting sand core 40.

The casing sand core 40 shown in FIG. 2 is an example for explaining a principle as to how burrs are formed and its shape is schematically drawn. As shown in FIG. 2, the casting sand core 40 is a plate-like member with circular openings 41 formed therein. As shown in FIG. 3, the casting sand core 40 is formed by injecting sand that has been mixed with a binder such as water glass and kneaded (kneaded sand) into a space between an upper die 50 and a lower die 60 abutting against each other.

Therefore, burrs 42 are formed on the casting sand core 40 along a surface on which the upper and lower dies 50 and 60 abut against each other, i.e., along a parting surface of the dies. The burrs 42 could be formed on an outer peripheral surface of the casting sand core 40 and inner peripheral surfaces of the openings 41. In FIG. 2, illustration of the burrs 42 is omitted.

<Method for Removing Burrs of Casting Sand Core>

Figure 4:
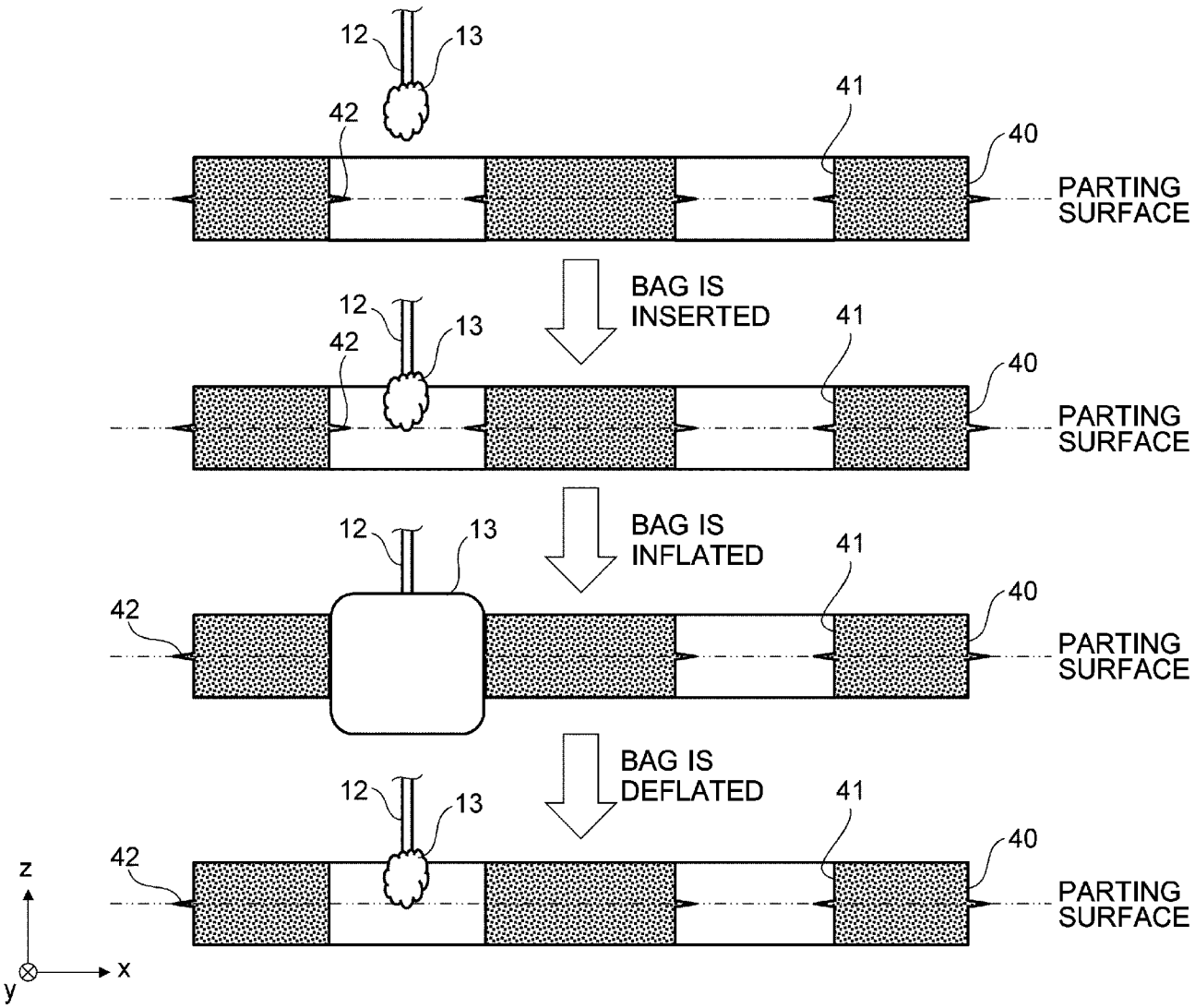
FIG. 4 is a cross section showing a method for removing burrs of a casting sand core according to the first embodiment.

Next, a method for removing burrs of a casting sand core according to the first embodiment is described with reference to FIG. 4. FIG. 4 is a cross-sectional flow diagram showing a method for removing burrs of a casting sand core according to the first embodiment. FIG. 4 shows a method for removing burrs 42 formed on the inner peripheral surface of one of the openings 41 of the casting sand core 40. Burrs 42 formed on the inner peripheral surface of the other opening 41 are removed by performing a similar process for the other opening 41.

Firstly, as shown in the uppermost part in FIG. 4, the bag 13 is moved to a position directly above one of the openings 41.

Next, as shown in the second part in FIG. 4, the bag 13 is moved in the z-axis negative direction and inserted into the opening 41. Note that since the bag 13 is attached to the tip of the nozzle 12, the bag 13 can be easily inserted even when the opening 41 is small.

Next, as shown in the third part in FIG. 4, air is supplied to the bag 13 and hence the bag 13 is inflated. In this process, burrs 42 formed on the inner peripheral surface of the opening 41 are pressed and broken off (e.g., snapped) by the inflated bag 13, and hence removed. Note that since the burrs 42, which are made of sand, are fragile, they can be easily pressed and broken off by the inflated bag 13.

Lastly, as shown in the third part in FIG. 4, when a pressure inside the bag 13 rises to a predetermined reference value, the supply of air to the bag 13 is stopped. After that, air is discharged from the bag 13 and hence the bag 13 is deflated.

After that, the bag 13 is moved to the other opening 41 and the above-described operation is repeated. As a result, burrs 42 formed on the inner peripheral surface of the other opening 41 are removed.

As described above, in the method for removing burrs of a casting sand core according to the first embodiment, the bag 13 is inflated inside the opening 41 of the casting sand core 40. Then, burrs 42 formed on the inner peripheral surface of the opening 41 are pressed and broken off, and hence removed by the inflated bag 13.

Note that a roughly uniform pressure is applied over the entire inner peripheral surface of the opening 41 by the inflated bag 13. Therefore, it is possible to prevent burrs 42 from being locally and excessively removed and prevent areas having no burr 42 formed therein from being unnecessarily scraped on the inner peripheral surface of the opening 41. That is, it is possible to sufficiently remove burrs while preventing a main body of a casting sand core from being damaged.

Specific Application Example

Next, a specific application example of the method for removing burrs of a casting sand core according to the first embodiment is described with reference to FIGS. 5 to 8.

Figure 5:
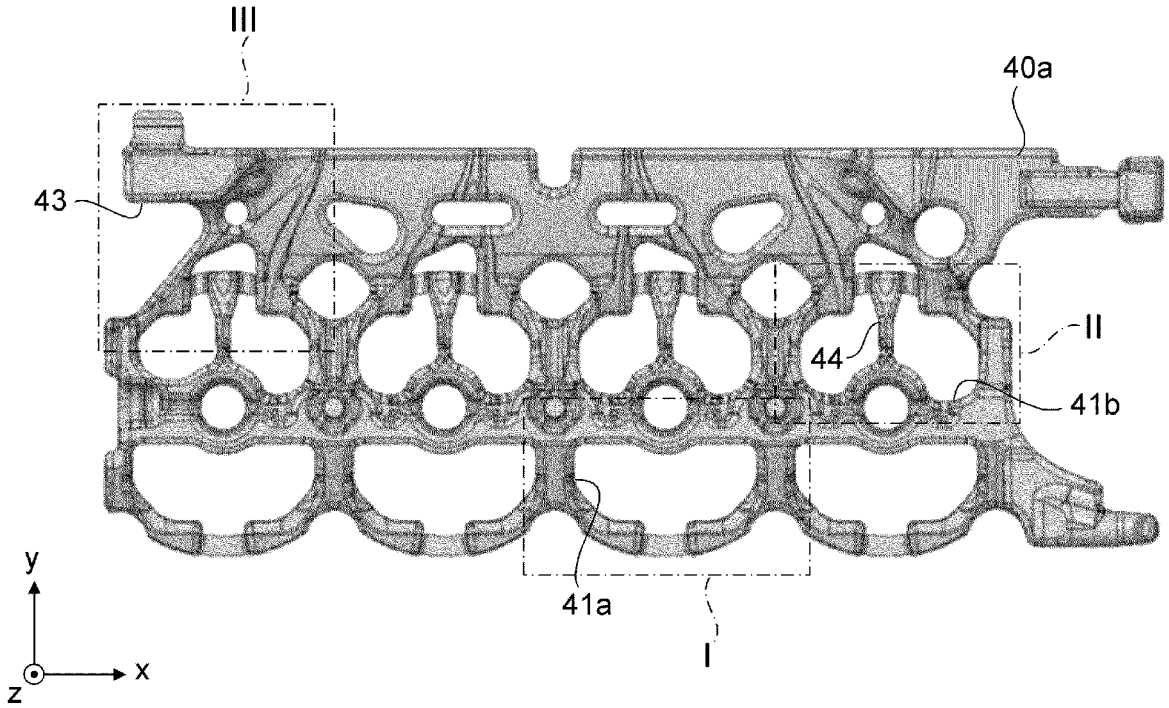
FIG. 5 is a schematic plan view of another example of a casting sand core from which burrs are removed by using a method for removing burrs of a casting sand core according to the first embodiment.
Figure 6:
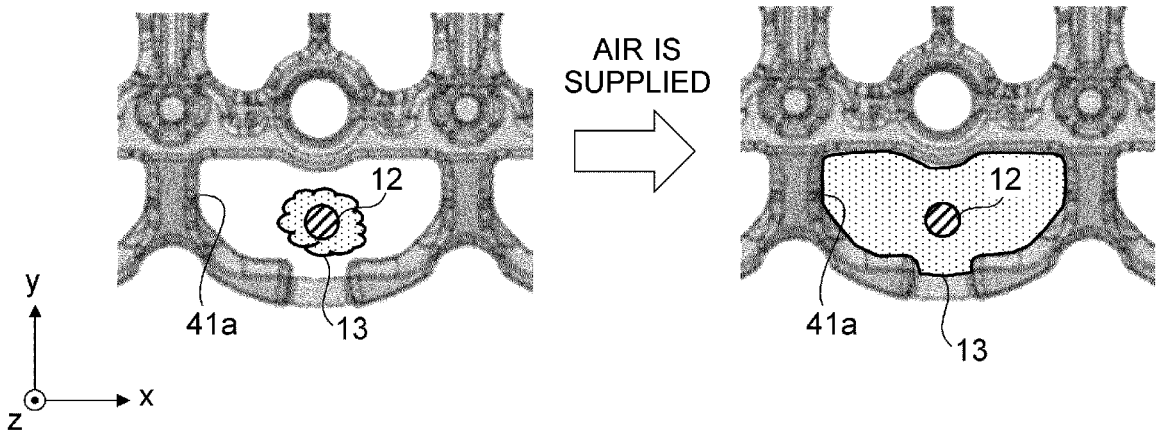
FIG. 6 is an enlarged partial view showing how burrs are removed in an area I in FIG. 5.
Figure 7:
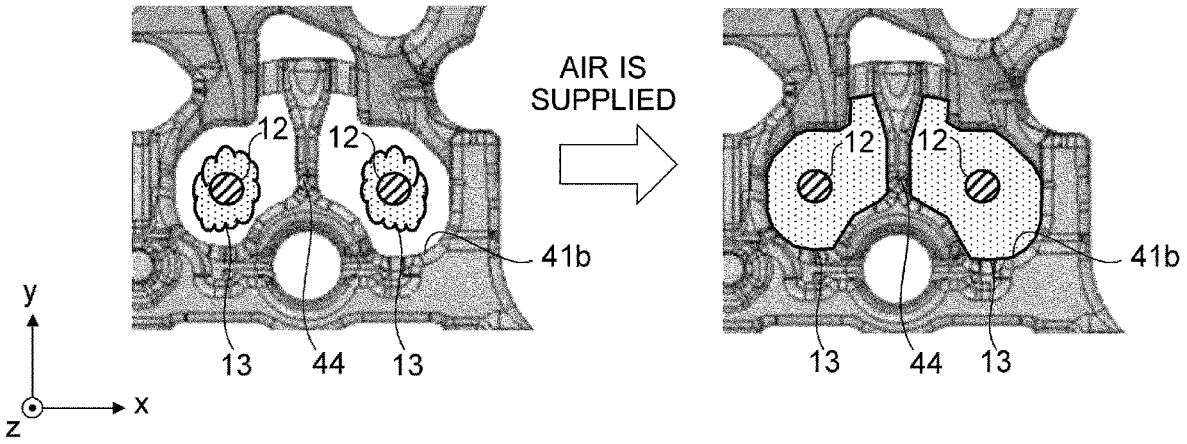
FIG. 7 is an enlarged partial view showing how burrs are removed in an area II in FIG. 5.
Figure 8:
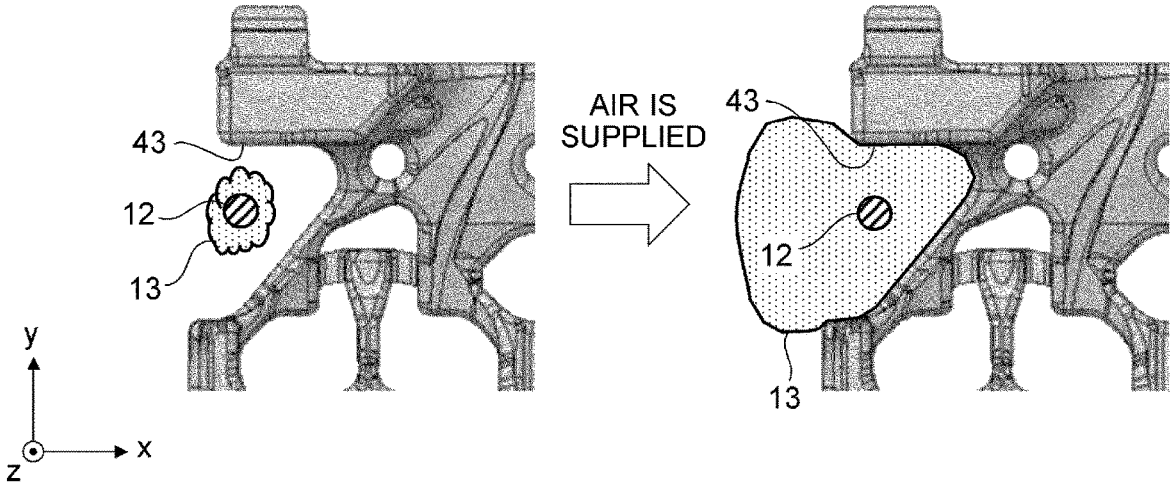
FIG. 8 is an enlarged partial view showing how burrs are removed in an area III in FIG. 5.

FIG. 5 is a schematic plan view of another example of a casting sand core from which burrs are removed by using the method for removing burrs of a casting sand core according to the first embodiment. FIG. 6 is an enlarged partial view showing how burrs are removed in an area I in FIG. 5. FIG. 7 is an enlarged partial view showing how burrs are removed in an area II in FIG. 5. FIG. 8 is an enlarged partial view showing how burrs are removed in an area III in FIG. 5.

A casting sand core 40*a* shown in FIG. 5 is a core for forming a water channel of a cylinder head. As shown in FIG. 5, in the casting sand core 40*a*, roughly semicircular openings 41*a*, roughly quadrantal openings 41*b* each two of which are opposed to each other with a partition part 44 interposed therebetween, and a cut-out part 43 are formed.

Burrs (not shown) are formed on the inner peripheral surfaces of the openings 41*a* and openings 41*b* in a manner similar to the burrs 42 formed on the inner peripheral surfaces of the openings 41 shown in FIG. 3. Similarly, burrs (not shown) are formed on the peripheral surface of the cut-out part 43.

FIG. 6 shows how burrs formed on the inner peripheral surface of the opening 41*a* are removed. After inserting the bag 13 into the opening 41*a* as shown on the left side in FIG. 6, air is supplied to the bag 13 and hence the bag 13 is inflated as shown on the right side in FIG. 6. In this process, burrs formed on the inner peripheral surface of the opening 41*a* are pressed and broken off (e.g., snapped) by the inflated bag 13, and hence removed.

FIG. 7 shows how burrs formed on the inner peripheral surface of the opening 41*b* are removed. As shown in FIG. 7, a pair of openings 41*b* is arranged so as to be opposed to each other with a low-strength partition part 44 interposed therebetween. Note that if the bag 13 is inserted and inflated only in one of the openings 41*b*, the partition part 44 could be broken by a force that is exerted by the bag 13 and presses the partition part 44 in the x-axis direction.

Therefore, as shown on the left side in FIG. 7, a separate bag 13 is inserted into each one of the pair of opposed openings 41*b*. After that, as shown on the right side in FIG. 7, air is simultaneously supplied to the two bags 13 and hence the two bags 13 are simultaneously inflated. In this case, the partition part 44 is sandwiched between the two inflated bags 13 and forces that are exerted by the two bags 13 and press the partition part 44 in the x-axis direction cancel out each other. Therefore, burrs formed on the inner peripheral surface of each of the opening portions 41*a* can be pressed and broken off by the respective one of the inflated bags 13, and hence removed without breaking the partition part 44.

FIG. 8 shows how burrs formed on the peripheral surface of the cut-out part 43 are removed. The cut-out part 43 is provided on the outer periphery of the casting sand core 40*a*. As shown on the left side in FIG. 8, after inserting the bag 13 into the cut-out part 43, air is supplied to the bag 13 and hence the bag 13 is inflated as shown on the right side in FIG. 8. In this process, burrs formed on the peripheral surface of the cut-out part 43 are pressed and broken off by the inflated bag 13, and hence removed.

As described above, by using the method for removing burrs of a casting sand core according to the first embodiment, it is possible to remove burrs formed on the peripheral surface of the cut-out part 43 as well as burrs formed on the inner peripheral surfaces of the openings 41*b*. That is, the part to be deburred (also referred to as the "deburring target part" in this specification) is not limited to the openings. For example, the part to be deburred may be a cut-out part.

Figure 9:
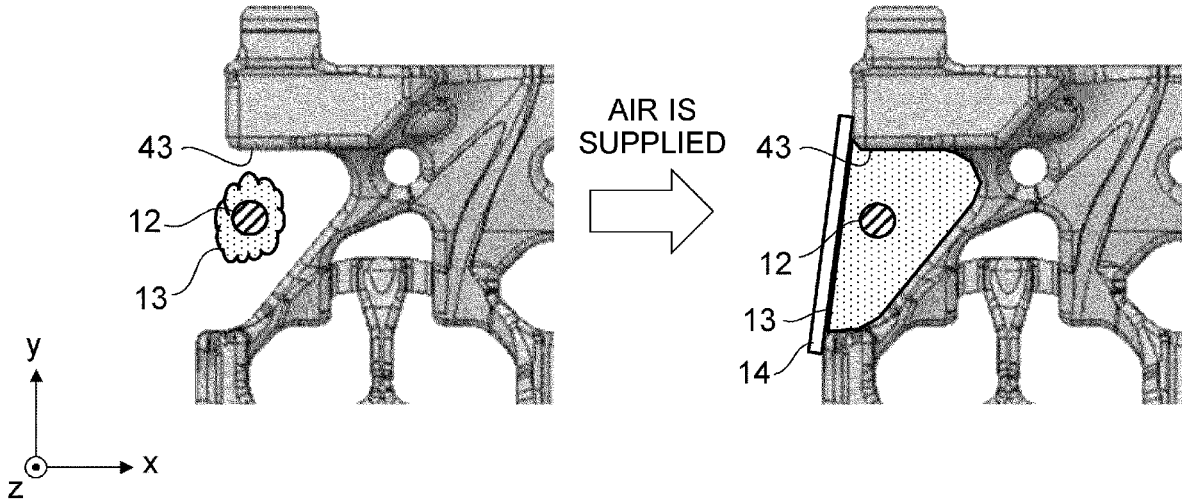
FIG. 9 is an enlarged partial view showing how burrs are removed in an area III in FIG. 5.

Here, FIG. 9 is also an enlarged partial view showing how burrs are removed in the area III in FIG. 5. As shown in FIG. 9, the plate-shaped member 14 may be placed to abut against the outer periphery of the casting sand core 40*a* and thereby to cover the cut-out part 43. In FIG. 8, the bag 13 is inflated while protruding from the cut-out part 43 of the casting sand core 40*a*. In contrast to this, in FIG. 9, by covering the cut-out part 43 with the plate-like member 14, the amount of supplied air can be reduced and hence burrs can be effectively removed.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A deburring method for a casting sand core for removing a burr from a deburring target part in the casting sand core including the deburring target part, the deburring target part being at least one of an opening and a cut-out part, the deburring method comprising:

inserting a bag into the deburring target part of the casting sand core; and inflating the bag inserted into the deburring target part, and thereby pressing and breaking off a burr formed on a peripheral surface of the deburring target part by the inflated bag.

2. The deburring method for a casting sand core according to claim 1, wherein when a pair of deburring target parts is arranged so as to be opposed to each other with a partition part interposed therebetween, after the bag and another bag are separately inserted into the pair of deburring target parts respectively, the bag and the other bag, which have been separately inserted into the pair of deburring target parts respectively, are simultaneously inflated.

3. The deburring method for a casting sand core according to claim 1, wherein the deburring target part is a cut-out part, and the bag inserted into the deburring target part is inflated after a plate-shaped member is placed to abut against an outer periphery of the casting sand core and thereby to cover the cut-out part.

4. The deburring method for a casting sand core according to claim 1, wherein the bag is inflated by supplying air to the bag.

5. The deburring method for a casting sand core according to claim 1, wherein the bag is attached to a tip of a nozzle.

* * * * *